US012012769B2

(12) United States Patent
Melic

(10) Patent No.: US 12,012,769 B2
(45) Date of Patent: Jun. 18, 2024

(54) SAFETY NET AND SAFETY NET COMPONENTS FOR MULTI-STOREY BUILDING CONSTRUCTION

(71) Applicant: Jonathan Jonny Melic, Burlington (CA)

(72) Inventor: Jonathan Jonny Melic, Burlington (CA)

( * ) Notice: Subject to any disclaimer, the term of this patent is extended or adjusted under 35 U.S.C. 154(b) by 899 days.

(21) Appl. No.: 16/961,867

(22) PCT Filed: Jan. 16, 2019

(86) PCT No.: PCT/CA2019/050058

§ 371 (c)(1),
(2) Date: Jul. 13, 2020

(87) PCT Pub. No.: WO2019/140521

PCT Pub. Date: Jul. 25, 2019

(65) Prior Publication Data

US 2020/0347625 A1 Nov. 5, 2020

Related U.S. Application Data

(60) Provisional application No. 62/619,145, filed on Jan. 19, 2018.

(51) Int. Cl.
*E04G 21/32* (2006.01)

(52) U.S. Cl.
CPC ..... *E04G 21/3266* (2013.01)

(58) Field of Classification Search
CPC ..... E04G 21/3266; E04G 21/3261; E04G 21/3276; E04G 21/3204; E04G 21/329;
(Continued)

(56) References Cited

U.S. PATENT DOCUMENTS 567,642 A * 9/1896 Fitzhugh ..... E04G 21/3261 182/138
3,949,834 A * 4/1976 Nusbaum ..... E04G 21/3266 182/138

(Continued)

FOREIGN PATENT DOCUMENTS

KR 20110057704 A * 6/2011
KR 20110057704 A 6/2011
WO 2017120666 A1 7/2017

OTHER PUBLICATIONS

KR-20110057704A (Year: 2011).*

(Continued)

*Primary Examiner* — Jessica L Laux
*Assistant Examiner* — Kathleen M. McFarland
(74) *Attorney, Agent, or Firm* — Crowe & Dunlevy, P.C.

(57) ABSTRACT

A safety net and a safety net frame for multi-storey building construction. The safety net has a first netting support secured to a plurality of floor engaging portions, each having a support arm rotatably attached thereto; a second netting support secured to the support arms; and netting, spanning said the netting supports such that rotation of the support arms causes the netting to move between a deployed and a stowed configuration. Each support arm has a brace. When the netting is deployed the brace extends between the support arm and its respective floor engaging portion such that a vertical load applied to the netting is at least partially transmitted by the brace from the support arm to its respective floor engaging portion, and a floor structure to which it is secured, to resist the netting moving to its stowed configuration.

14 Claims, 13 Drawing Sheets

(58) Field of Classification Search
CPC ..... E04G 21/3223; E04G 21/3219; E04G 21/3242; E04G 21/32; E04G 2005/148
See application file for complete search history.

(56) References Cited

U.S. PATENT DOCUMENTS 3,995,833 A * 12/1976 McLaughlin ..... E04G 21/3242 256/65.14
4,119,176 A * 10/1978 Verdu ..... E04G 21/3261 182/138
4,347,024 A * 8/1982 Coldren ..... F16B 43/00 411/156
4,483,648 A * 11/1984 Trungold ..... F16B 31/028 411/10
4,732,234 A * 3/1988 Brickman ..... E04G 21/3266 182/138
4,838,382 A * 6/1989 Nusbaum ..... E04G 21/3261 182/138
4,856,615 A * 8/1989 Nusbaum ..... E04G 21/3261 182/138
4,892,169 A * 1/1990 Duncan ..... E04G 21/3261 182/138
4,944,365 A * 7/1990 Shalders ..... E04G 21/3266 182/138
4,962,828 A * 10/1990 Duncan ..... E04G 21/3266 182/138
4,982,813 A * 1/1991 Starr ..... E04G 21/3261 182/138
5,083,636 A * 1/1992 Goldenberg ..... E04G 21/3266 182/138
5,161,641 A * 11/1992 Nusbaum ..... E04G 21/3223 182/138
5,299,654 A * 4/1994 Duncan ..... E04G 21/3266 182/138
5,429,206 A * 7/1995 Nusbaum ..... E04G 21/3266 182/138
5,582,266 A * 12/1996 Rexroad ..... E04G 21/3266 182/138
5,673,769 A * 10/1997 Rexroad ..... A62B 1/22 182/138
5,848,665 A * 12/1998 Rexroad ..... E04G 21/3266 182/138
6,000,498 A * 12/1999 Rexroad ..... E04G 21/3261 182/138
6,161,648 A * 12/2000 Rexroad ..... E04G 21/3261 182/138
7,258,198 B2 * 8/2007 Rexroad ..... E04G 21/3266 182/138
7,273,200 B2 * 9/2007 Funes Gavilan ..... E04G 25/06 256/65.01
7,322,553 B2 * 1/2008 Rexroad ..... E04G 21/3261 182/138
7,389,855 B2 * 6/2008 Rexroad ..... E04G 21/3261 182/138
8,376,086 B1 * 2/2013 Moyer ..... E04G 21/3266 182/138
9,556,578 B1 * 1/2017 LaMora, Jr. ..... E04G 21/3204
10,294,682 B2 * 5/2019 Cockerell ..... E04G 21/3266
10,465,401 B2 * 11/2019 Berry ..... E04G 21/32
2006/0090961 A1 * 5/2006 Rexroad ..... A62B 1/22 182/138
2006/0213723 A1 * 9/2006 Rexroad ..... E04G 21/3266 182/138
2006/0213724 A1 * 9/2006 Rexroad ..... E04G 21/3261 182/138
2006/0214071 A1 * 9/2006 Rexroad ..... E04G 21/3266 248/200
2006/0214150 A1 * 9/2006 Cockerell ..... E04G 21/3266 256/67
2009/0101779 A1 * 4/2009 Snider ..... E04G 21/3266 248/229.1
2009/0120718 A1 * 5/2009 O'Gorman ..... E04G 21/3295 182/138
2016/0305138 A1 * 10/2016 Bullock ..... E04G 21/32
2017/0159304 A1 * 6/2017 Young ..... E04G 21/32
2017/0297671 A1 * 10/2017 LaMora, Jr. ..... B63B 35/32
2018/0347218 A1 * 12/2018 Cockerell ..... E04G 21/3266
2020/0318298 A1 * 10/2020 Pilge ..... E01D 19/106

OTHER PUBLICATIONS

International Search Report and Written Opinion for PCT/CA2019/050058 dated Mar. 29, 2019.
International Preliminary Report on Patentability in PCT/CA2019/050058 dated Jul. 21, 2020.

* cited by examiner

SAFETY NET AND SAFETY NET COMPONENTS FOR MULTI-STOREY BUILDING CONSTRUCTION

FIELD

This invention relates generally to the field of safety nets used in the construction of multi-storey buildings.

BACKGROUND

During the construction of multi-storey buildings, and in particular high rise office buildings, apartments and condominiums, it is often a legal requirement to install a safety net or other form of containment system about the exterior perimeter of a floor under construction to protect workers and equipment below from being struck by objects that may unintentionally drop or fall from floors above. Commonly, such safety nets are secured to post structures that span between adjacent floors and that effectively "hang" the nets in a somewhat horizontal configuration, extending outwardly from the side of the building. Objects that may become dislodged or otherwise fall from above can then be caught by the nets, preventing damage or injury to equipment or people below.

A variety of different safety nets have been developed for such applications. Conventional safety nets operate with varying degrees of functionality and efficiency. In each instance the netting material can at times be exposed to a considerable load, particularly if a relatively heavy object strikes it after falling from a significant height. To account for that loading, conventional safety nets are commonly secured to either two, or in some cases three, separate floors of the building under construction. The mechanical structure required to both support the safety nets and to accommodate the load to which it may be exposed can be significant and relatively complex, and can often be expensive and of a considerable weight.

There is a continual need to improve currently existing safety nets in order to enhance their functionality, increase the efficiency by which they may be installed and moved from floor to floor during the construction process, minimize their cost, and/or enhance the level of safety or protection that they provide.

SUMMARY

The invention therefore provides a safety net for multi-storey building construction, the safety net comprising a first netting support secured to a plurality of floor engaging portions, each floor engaging portion having a support arm rotatably attached thereto; a second netting support secured to said support arms; and netting, secured to said first and said second netting supports such that rotation of said support arms causes said netting to move between a deployed and a stowed configuration, each support arm having a brace, when said netting is in said deployed configuration said brace extending between said support arm and its respective floor engaging portion such that the horizontal component of a load applied to said support arm is at least partially transmitted by said brace from said support arm directly to said respective floor engaging portion, resisting said netting moving to said stowed configuration.

In a further aspect the invention provides a safety net frame for a multi-storey building construction, the safety net frame comprising a plurality of floor engaging portions, each floor engaging portion having a support arm with a first end rotatably to said floor engaging portion such that rotation of said support arms relative to said floor engaging portions causes said frame to move between a deployed and a stowed configuration; a first netting support secured to said floor engaging portions; a second netting support secured to second opposite ends of said support arms; and a brace associated with each of said support arms, each of said braces having a first end rotatably secured to its respective support arm and having a second end releasably securable to a brace retainer on its respective floor engaging portion, said second ends of said braces disengaged from their respective brace retainers when said frame is in said stowed configuration; when said frame is in said deployed configuration said braces extending between said respective support arms and their respective floor engaging portions such that the horizontal component of a load applied to said support arms, is at least partially transmitted by said braces from said support arms directly to said respective floor engaging portions, resisting said frame moving to said stowed configuration.

In another aspect the invention provides a safety net for multi-storey building construction, the safety net comprising a first netting support secured to a plurality of floor engaging portions, each floor engaging portion having a support arm rotatably attached thereto, each floor engaging portion including an upper jaw having a floor engaging pin receivable within a detent in an upper surface of a floor structure, said pins resisting sliding movement of said upper jaws relative to the floor structure when said safety net is secured thereto; a second netting support secured to said support arms; and netting, secured to said first and said second netting supports such that rotation of said support arms causes said netting to move between a deployed and a stowed configuration.

The invention also provides a safety net for multi-storey building construction, the safety net comprising a plurality of floor engaging portions, each floor engaging portion having a support arm rotatably attached thereto, each floor engaging portion including an upper jaw engageable with an upper surface of a floor structure; for each floor engaging portion, at least one floor engaging pin receivable within a detent in the upper surface of the floor structure to resist sliding movement of said upper jaws relative to the floor structure when said safety net is secured thereto; a first netting support secured to a plurality of said floor engaging portions; a second netting support secured to said support arms; netting, secured to said first and said second netting supports; and a post for tensioning between the floor structure and an adjacent above floor structure, said post engageable with said upper jaw when tensioned in place between said floor structures to maintain said upper jaw in contact with the upper surface of the floor structure and to maintain said floor engaging pin within the detent.

Further aspects of the invention will become apparent from the following description taken together with the accompanying drawings.

BRIEF DESCRIPTION OF THE DRAWINGS

For a better understanding of the present invention, and to show more clearly how it may be carried into effect, reference will now be made, by way of example, to the accompanying drawings which show exemplary embodiments of the present invention in which:

FIG. 8*a* is an enlarged detailed view of portion "A" of FIG. 8.

FIG. 8*b* is a view subsequent to FIG. 8*a* wherein the brace of the safety net is in the process of being disengaged from the floor engaging portion.

FIG. 8*c* is a view subsequent to FIG. 8*b* where the brace has been disengaged from the floor engaging portion.

DESCRIPTION

The present invention may be embodied in a number of different forms. The specification and drawings that follow describe and disclose some of the specific forms of the invention.

Figure 1:
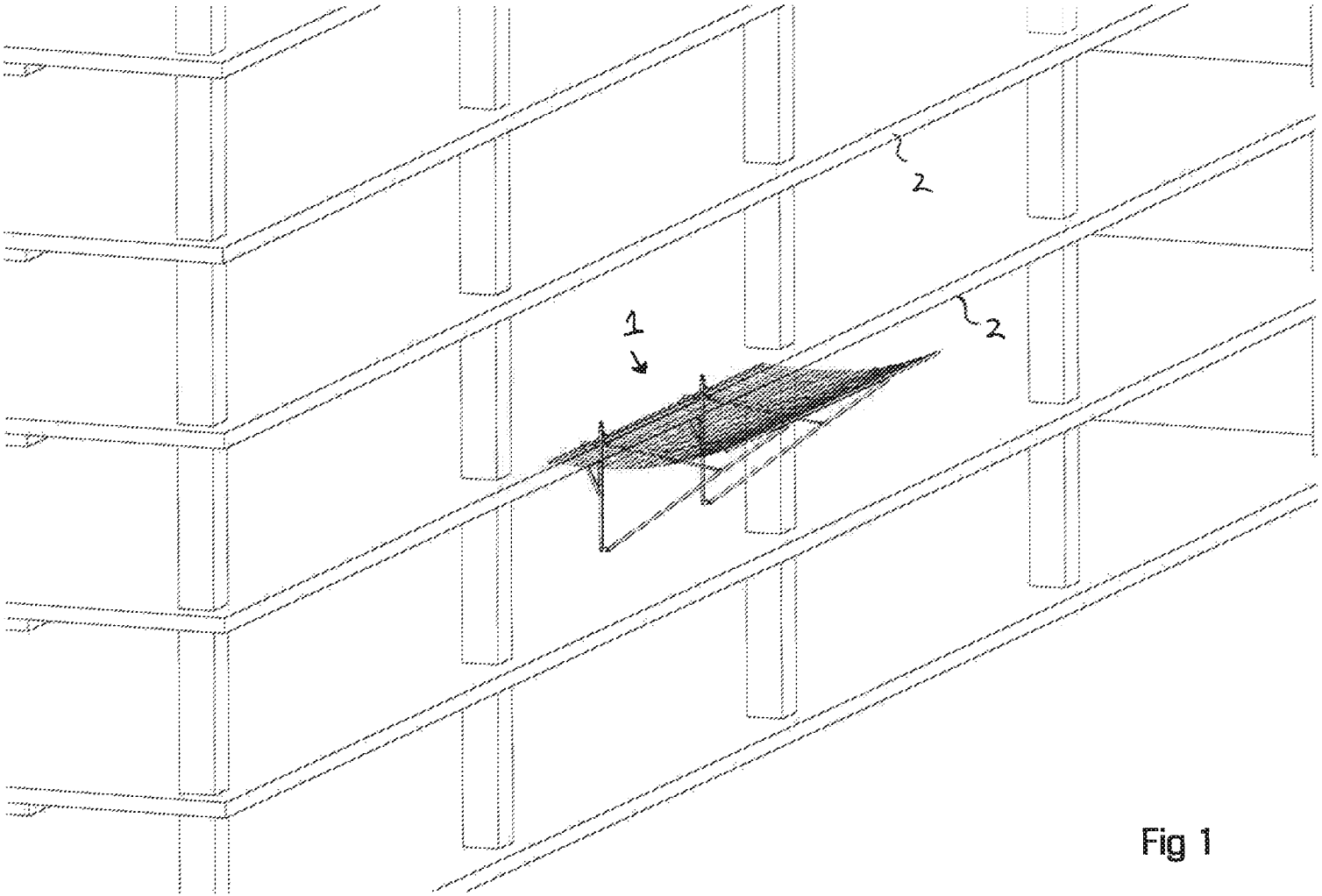
FIG. 1 is an upper side perspective view of a portion of a high rise building under construction demonstrating the use of a safety net in accordance with an embodiment of the invention, the safety net being in a deployed position.
Figure 2:
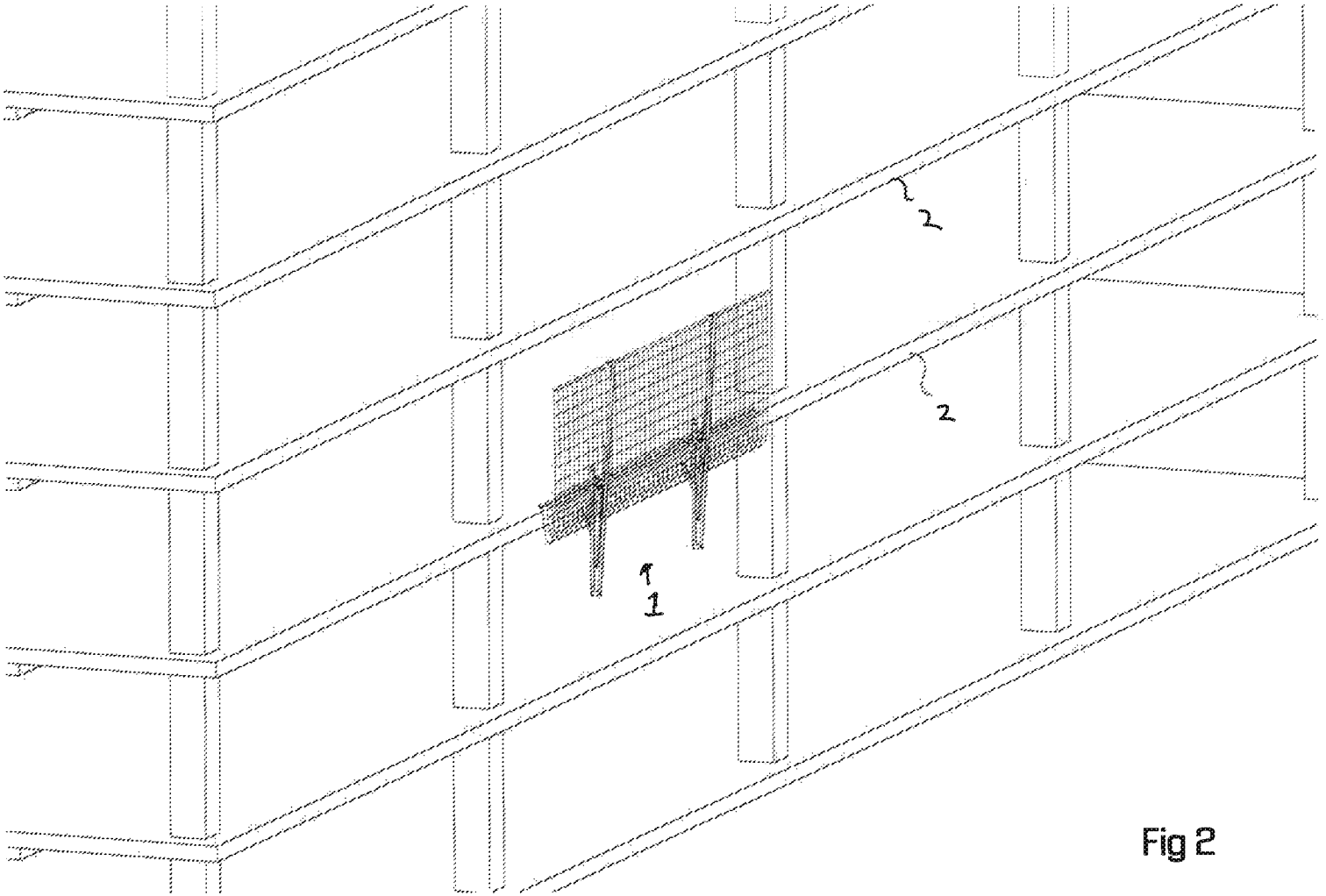
FIG. 2 is a view similar to FIG. 1 wherein the safety net is in a retracted or stowed position.

With reference to FIGS. 1 and 2, there is shown a safety net 1 constructed in accordance with an embodiment of the invention as it would typically be attached to the edge of a floor 2 of a building under construction. In FIG. 1 the safety net is shown in its extended or deployed configuration, while FIG. 2 depicts safety net 1 in a retracted or stowed configuration. It will be appreciated that in practice a number of such safety nets would typically be placed end to end along the edge of one or more floors under construction.

Figure 3:
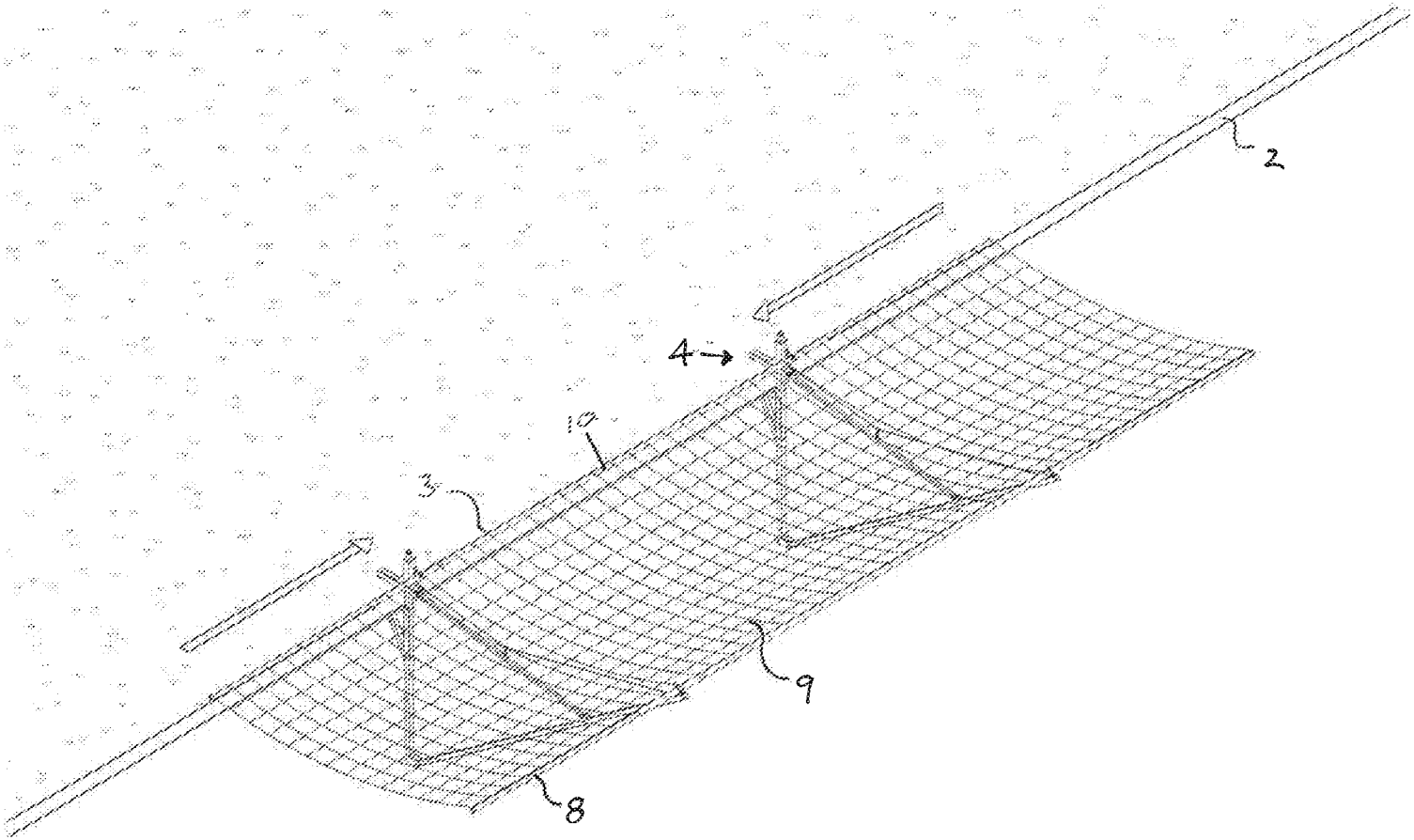
FIG. 3 is an upper perspective view of the safety net of FIG. 1.

Safety net 1 is comprised of a first netting support 3 secured or otherwise attached to a plurality of floor engaging portions 4. Each floor engaging portion 4 has rotatably attached to it a support arm 5. In the embodiment shown in the attached drawings, support arm 5 has a lower end 6 and an upper end 7. As shown, lower end 6 is hingedly secured to its associated floor engaging portion 4 while upper end 7 is vertically higher (in use) than first netting support 3 and has secured to it a second netting support 8. Second netting support 8 will be secured to the upper ends 7 of a plurality of support arms 5 (see for example FIG. 3) in any one of a variety of different possible manners. Safety net 1 further includes netting 9 that spans first and second netting supports 3 and 8. It will be appreciated that netting 9 may be secured to the netting supports in any one of a variety of different ways. In the particular embodiment shown in the attached drawings, first and second netting supports 3 and 8 are tubular or pipe structures and netting 9 is equipped along each of its longitudinal edges with one or more sleeves or grommets 10 that are received over a respective netting support in order to secure the netting thereto. Regardless of the manner in which the netting is secured to the netting supports, as shown in FIGS. 1 and 2 rotation of support arms 5 relative to their floor engaging portions causes the netting to move between a deployed and a stowed configuration. When in a deployed configuration (see FIG. 1) netting 9 will be held in a generally horizontal orientation, extending outwardly from the edge of floor 2. When in a retracted or stowed configuration (see FIG. 2) support arms 5 will be in a generally vertical orientation such that netting 9 is folded to a degree and extending generally perpendicular to floor 2.

Figure 4:
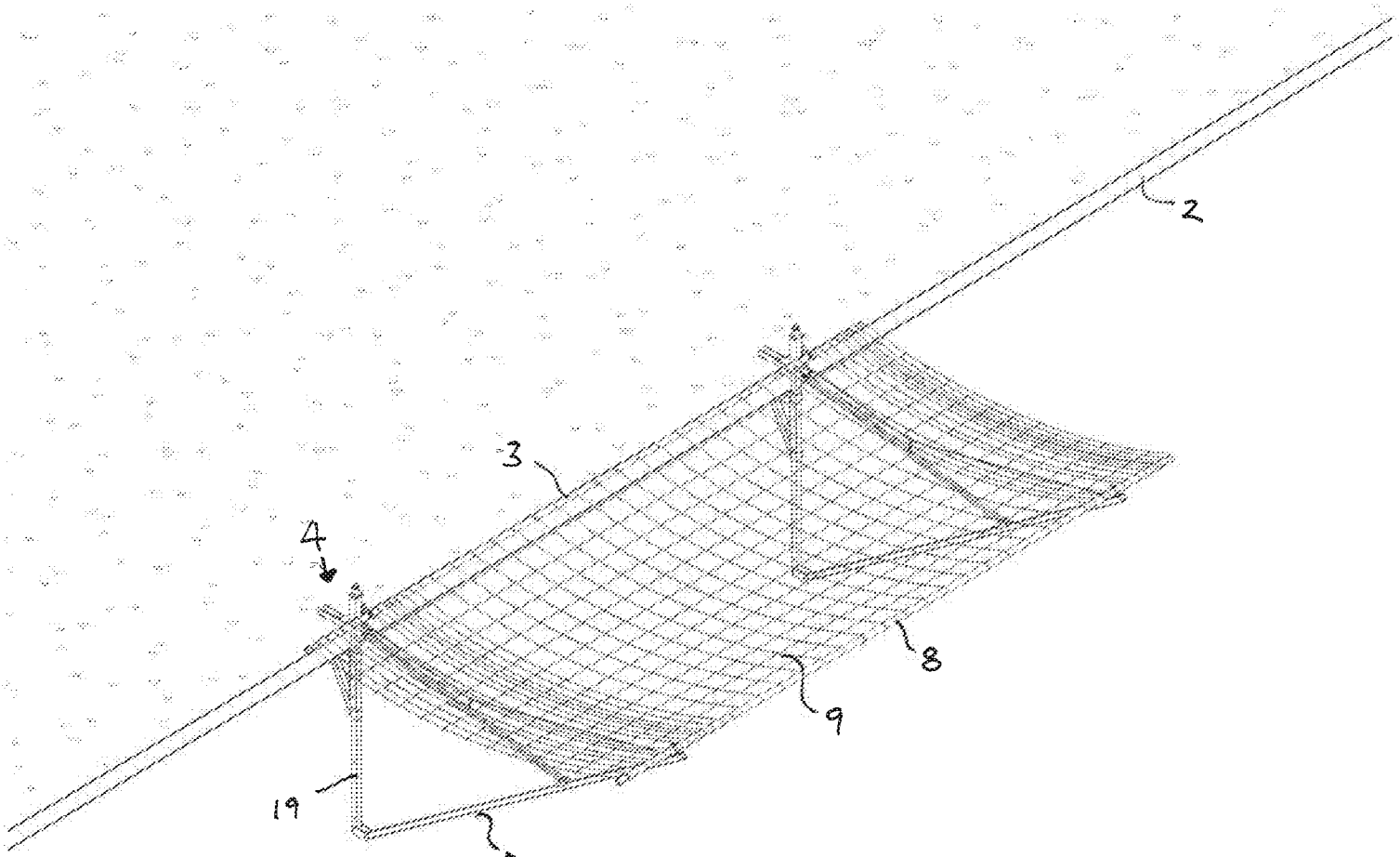
FIG. 4 is an upper side perspective view similar to FIG. 3, where the ends of the safety net have been telescoped inwardly to reduce its overall length.

In one embodiment, first and second netting supports 3 and 8 may be telescopic in nature to permit the overall length of the net to be extended (see FIG. 3) or retracted (see FIG. 4) as desired, including for transportation purposes. It will be appreciated that through making the outer end portions of netting supports 3 and 8 telescopic the integrity of the portions that span between two adjacent floor engaging portions (see FIG. 3) is not compromised. However, in alternate embodiments, other sections of netting supports 3 and 8 may be telescopic, including sections that may reside between two adjacent floor engaging portions.

Figure 5:
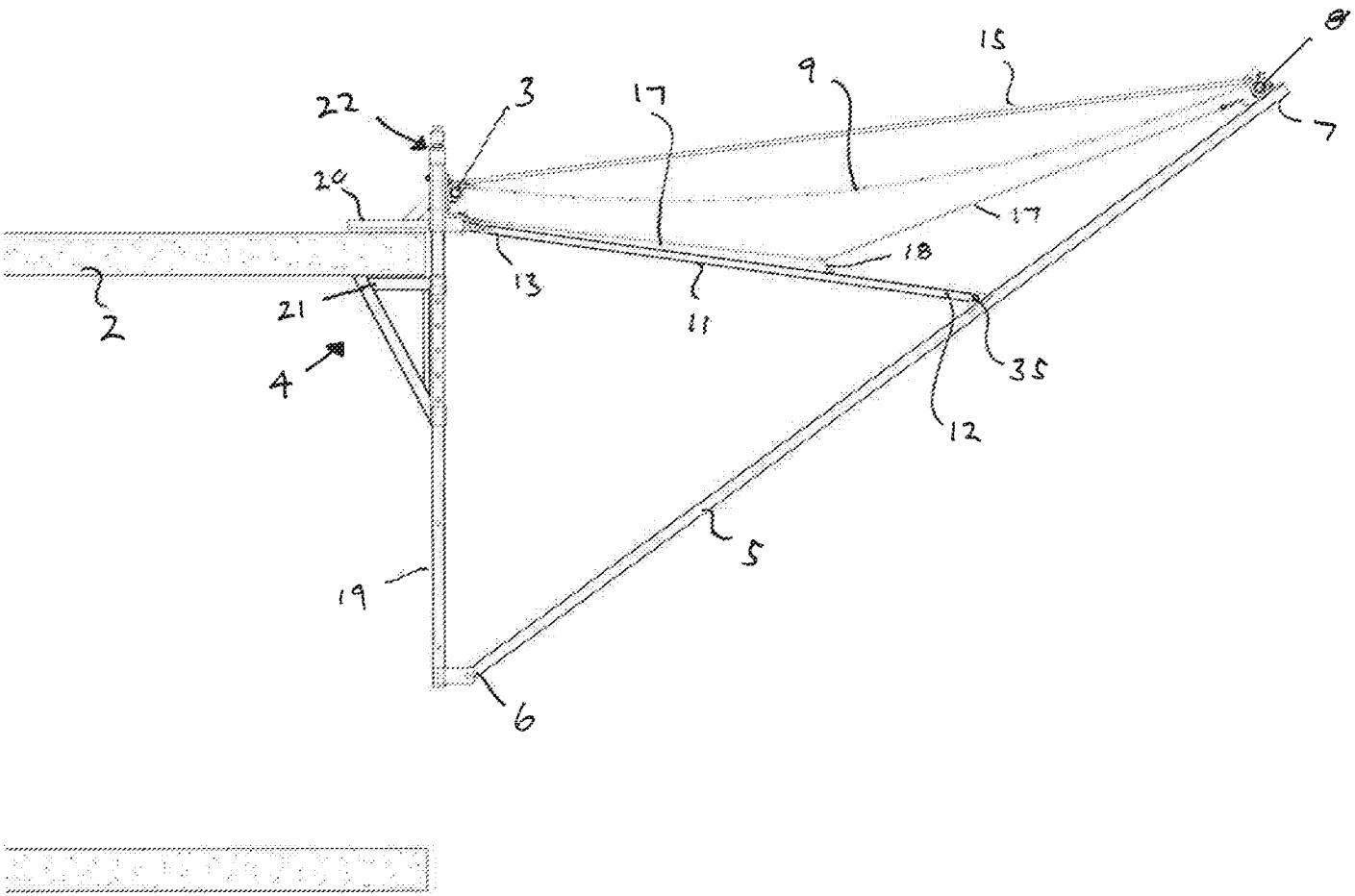
FIG. 5 is a left side elevational view of the safety net shown in FIG. 3.

With specific reference to FIG. 5, each support arm 5 further has associated with it a brace 11. When netting 9 is in its deployed configuration brace 11 extends between a support arm 5 and its respective floor engaging portion 4, beneath netting 9. A vertical load applied to netting 9 (such as would be the case if an object from above were to fall upon the netting, also referred to as a "live" load) will first be transmitted to the respective netting supports with at least part of the load being borne by second netting support 8. The load that is borne by second netting support 8 will be transferred to upper ends 7 of the support arms 5. At least a portion of the load borne by support arms 5 will then be transmitted by braces 11 from their respective support arms directly to upper jaws 20 (described in more detail below) of their respective floor engaging portions and ultimately to floor structure 2. Such a configuration of brace 11 thus helps to prevent netting 9 moving to its stowed configuration when acted upon by a generally vertically oriented force.

It will be appreciated that first netting support 3, second netting support 8, floor engaging portion 4 and brace 11 will collectively form a safety net frame.

To permit safety net 1 to be moved between its deployed and stowed configurations, in one embodiment of the invention each of braces 11 has a first end 12 fixed and rotatably secured to its respective support arm 5. In the particular embodiment shown in the attached drawings first ends 12 are secured to support arms 5 by means of a stirrup connection 35 on brace 11 (see FIG. 5). Stirrup connection 35 may be comprised of one, or a pair, of flanges upon support arm 5, with a bolt, pin or similar structure received therethrough and through first end 12 of brace 11 to rotatable secure brace 11 to support arm 5. Stirrup connection 35 may be located along the length of support arm 5 such that brace 11 is relatively horizontal in operation in order to help to minimize torque applied to brace 11. Further, stirrup connection 35 may be positioned between upper end 7 and the mid-point of support arm 5 to minimize torque applied to support arm 5 during operation. Other forms of connection are possible and within the contemplated scope of the invention.

Braces 11 include second ends 13 that are releasably securable to their respective floor engaging portions 4. Each floor engaging portion 4 may be fitted with a brace retainer, which in the depicted embodiment is a yoke 27 into which may be received second end 13 of brace 11. Yoke 27 is comprised of a pair of spaced apart flanges 50 having a lateral support 51 extending therebetween. End 13 of brace 11 may include a quick disconnect member 52 having a hook structure 53 receivable over lateral support 51 to releasably secure end 13 of brace 11 to floor engaging portion 4. In one embodiment, a lock 54 may be used to lock end 13 to yoke 27 and to prevent an unintentional disengagement of end 13 from floor engaging portion 4.

With first and second ends 12 and 13 of brace 11 secured to support arm 5 and floor engaging portion 4, respectively, brace 11 will serve to maintain support arms 5 at their desired spacing away from floor engaging porting 4 in the event that netting 9 were to stretch upon use or exposure to heat or sunlight. That is, should netting 9 stretch, without brace 11 secured in place support arms 5 would rotate downwardly oriented, adding to the possibility that an object caught by netting 9 may roll off the outer edge of the netting, potentially creating a safety hazard.

Figure 8:
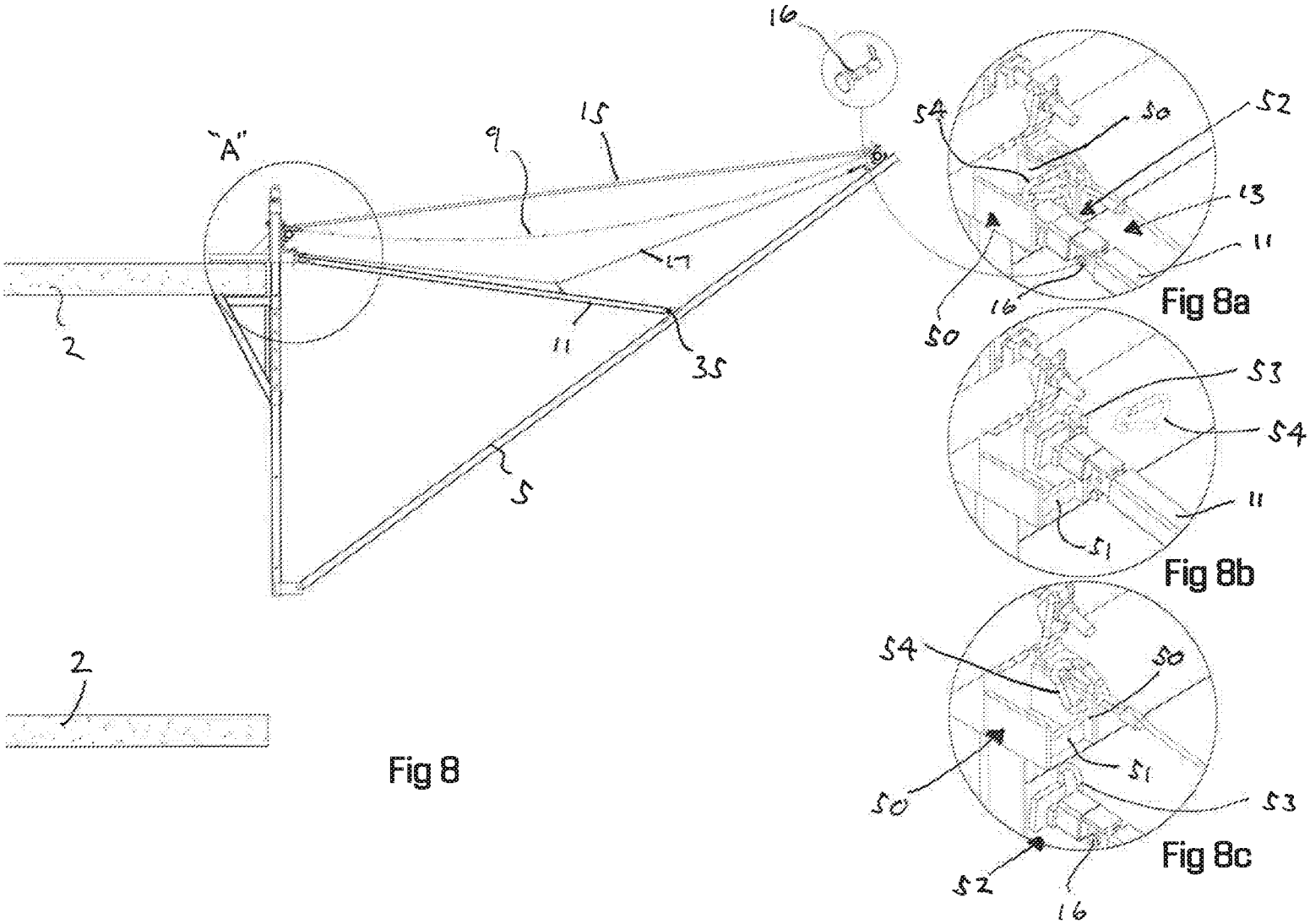
FIG. 8 is a side view of a safety net in accordance with an embodiment of the invention in a deployed configuration.

With reference to FIGS. 8*a*, 8*b* and 8*c*, end 13 of brace 11 is shown, first engaged with lateral support (FIG. 8*a*), secondly with lock 54 removed and in the process of being disengaged from lateral support 51 (FIG. 8*b*), and finally fully disengaged from lateral support 51 and free of floor engaging portion 4 (FIG. 8*c*).

End 13 of brace 11 may also include a shear pin 16 that secures quick disconnect member 52 to the end of brace 11. Under excessive loading (for example, through excessive force applied to netting 9 or by a high wind load borne by safety net 1) shear pin 16 will break along its shear zones to permit brace 11 to become disengaged from quick disconnect member 52 and hence floor engaging portion 4. Safety net 1 can then fold from its deployed toward its stowed configuration without bending or breaking under the force of the excessive loading. Where safety net 1 folds in such a manner on account of being exposed to high loading that results from a falling object, other than in exceptional circumstances the object will be retained within the netting as it folds. The load under which shear pin 16 will break can be designed according to the particular safety net and its operating conditions.

With the first ends 12 of braces 11 secured to their respective support arms, and second ends 13 of braces 11 secured to their respective floor engaging portions, safety net 1 will be in its deployed configuration such that a vertical load received by netting 9 (a "live" load) will be transmitted in the manner described above. Further, a horizontal wind load that may be borne by safety net 1 and/or support arm 5 will also be at least partially directed to the floor engaging portion 4 by operation of brace 11, reducing the load borne by other portions of safety net 1 and helping to prevent the net from unintentionally being moved to its stowed configuration. It will this be appreciated that the horizontal component of a load borne by support arm 5 will be transferred by its respective brace 11 directly to its respective floor engaging portion. By transferring wind loads and loads caused by falling objects directly to upper jaw 20, the establishment of a torque load on less robust aspects, or aspects that may be more susceptible to torque loading, of the floor engaging portion (and particular post 19, described below) is minimized. For example, in the embodiment depicted, brace 11 specifically transfers loading directly to upper jaw 20 and pin 23. In so doing the transferred load is borne by floor 2 with potentially damaging loads and/or torques directed away from other aspects or portions of the safety net, improving safety while also reducing the need (and hence cost and weight) of otherwise having to construct other portions of safety net 1 in a more robust manner. Orienting brace 11 in a somewhat horizontal configuration when in use also helps to more effectively transfer loading directly to floor 2.

Figure 10:
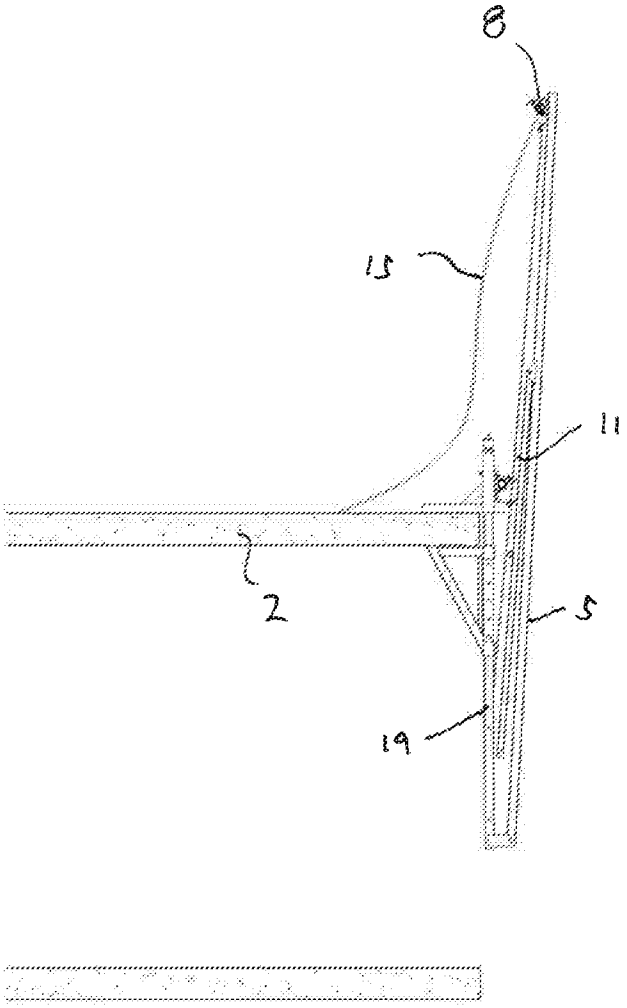
FIG. 10 is a side view similar to FIG. 9 when the safety net is in its retracted or stowed position.

To move a deployed safety net to its stowed position, the second ends 13 of braces 11 are disengaged from their respective floor engaging portions and allowed to drop downward by reason of first end 12 rotating within stirrup connection 35. The support arms can then be rotated upwardly into a generally vertical orientation (see FIG. 10). To assist in moving safety net 1 from its deployed to its stowed configuration, a cable or rope 15 may be secured to second netting support 8 such that pulling upon the cable or rope causes the support arms to rotate toward a vertical orientation.

Figure 9:
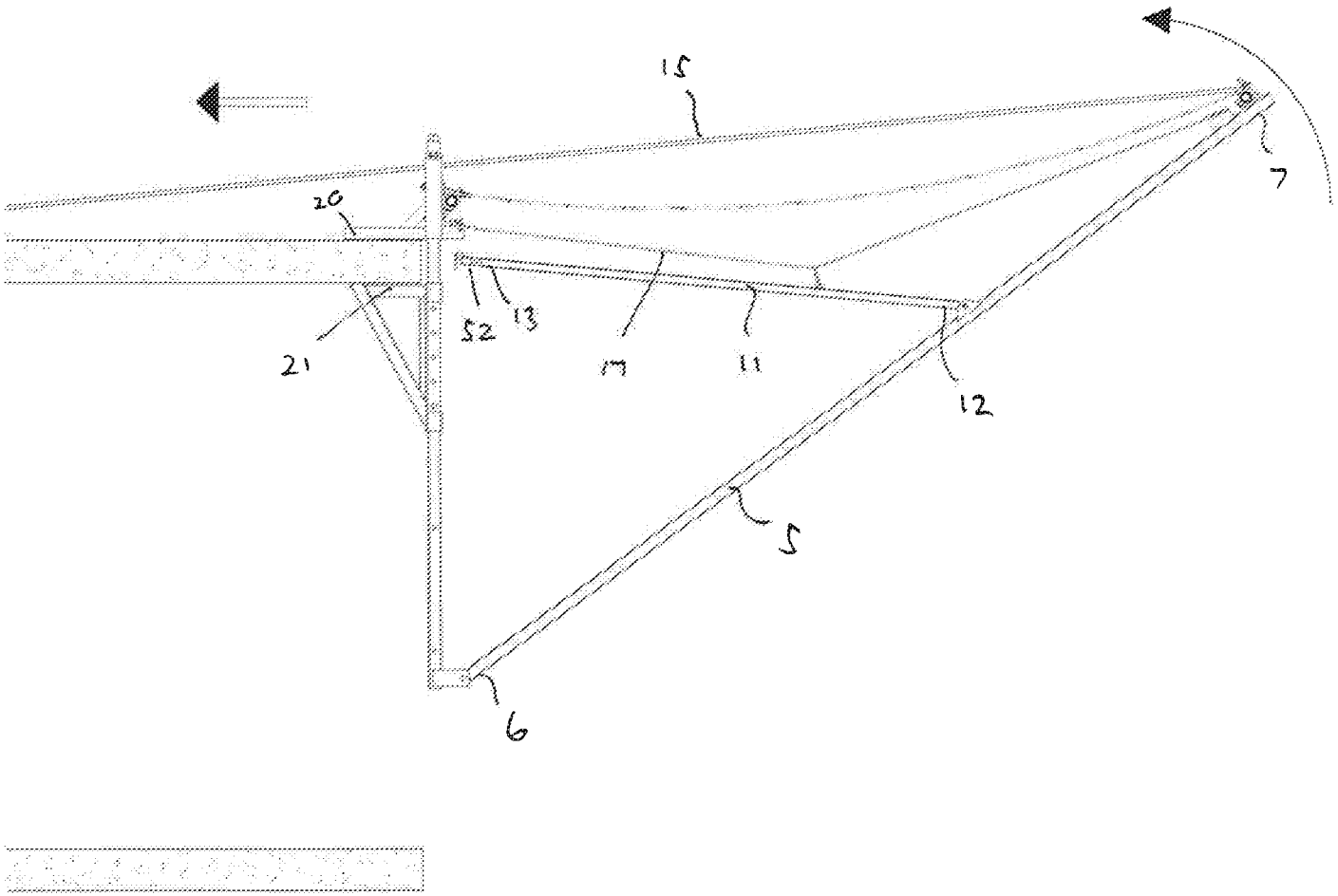
FIG. 9 is a side view similar to FIG. 7, wherein the brace has been disengaged from the floor engaging portion and the safety net is ready to be moved to its retracted or stowed position.

With particular reference to FIGS. 5 and 9, in an embodiment of the invention safety net 1 further includes a cable 17 associated with each brace 11. Cable 17 has a first end secured to first netting support 3 and a second end secured to second netting support 8. Each cable is also slidably engaged with its associated brace 11. The engagement of the cable with the brace may be accomplished by threading the cable through a cable receiver which may be in the form of a loop or eyelet 18 mounted upon the brace. A variety of other structures could be used to slidably engage cable 17 with brace 11. Cable 17 is of a length that permits the releasable securement of second end 13 of each brace 11 to its respective floor engaging portion, and that also permits safety net 1 to be moved from its deployed to its stowed configuration following disengagement of the second ends of the braces from their floor engaging portions (see FIGS. 9 and 10).

Further, it will be appreciated that when safety net 1 is in its stowed configuration, with braces 11 disengaged from floor engaging portions 4, rotating support arms 5 outwardly to their deployed position will thus cause a sliding engagement of braces 11 with cable 17, the result of which will be a lifting of second ends 13 upwardly into position for re-attachment to their respective floor engaging portions. Cable 17 will also serve as a safety mechanism helping to prevent support arms 5 from rotating outwardly beyond a distance that is permitted by the length of cables 17, particularly when second ends 13 of braces 11 are disconnected from floor engaging portions 4.

In accordance with the invention, floor engaging portions 4 generally comprise a vertically oriented post 19 having slidably received thereon an upper jaw 20 and a lower jaw 21. Although lower jaw 21 may be slidably received about post 19, once the thickness of floor structure 2 is determined it is expected that lower jaw 21 will be fixed in position relative to post 19 through the use of a pin, bolt, etc. In the case of the embodiment shown in the attached drawings, upper jaw 20 preferably includes an actuator 22 to slidably move the upper jaw so as to bias the pair of jaws against the upper and lower surfaces of floor structure 2. In alternate embodiments, actuator 22 may be associated with lower jaw 21, or may be associated with each of the upper and lower jaws. Further, upper jaw 20 may include a floor engaging pin 23 that is received within a hole, recess or detent 45 in the upper surface of floor structure 2 when the upper and lower jaws are engaged thereabout. Detent 45 will in most instances be relatively shallow to minimize floor damage. When received within the detent, floor engaging pin 23 will resist sliding movement of upper jaw 20 relative to floor structure 2, and assist in preventing safety net 1 from becoming dislodged from about floor structure 2 when in use, and particularly when exposed to operational and/or wind loading. It will further be appreciated that a load transmitted through brace 11 to floor engaging portion 4 will be at least partially transmitted to and borne by floor engaging pin 23. In alternate embodiments (not shown), pin 23 could be situated on lower jaw 21 and/or on each of upper and lower jaws 20 and 21.

Figure 6:
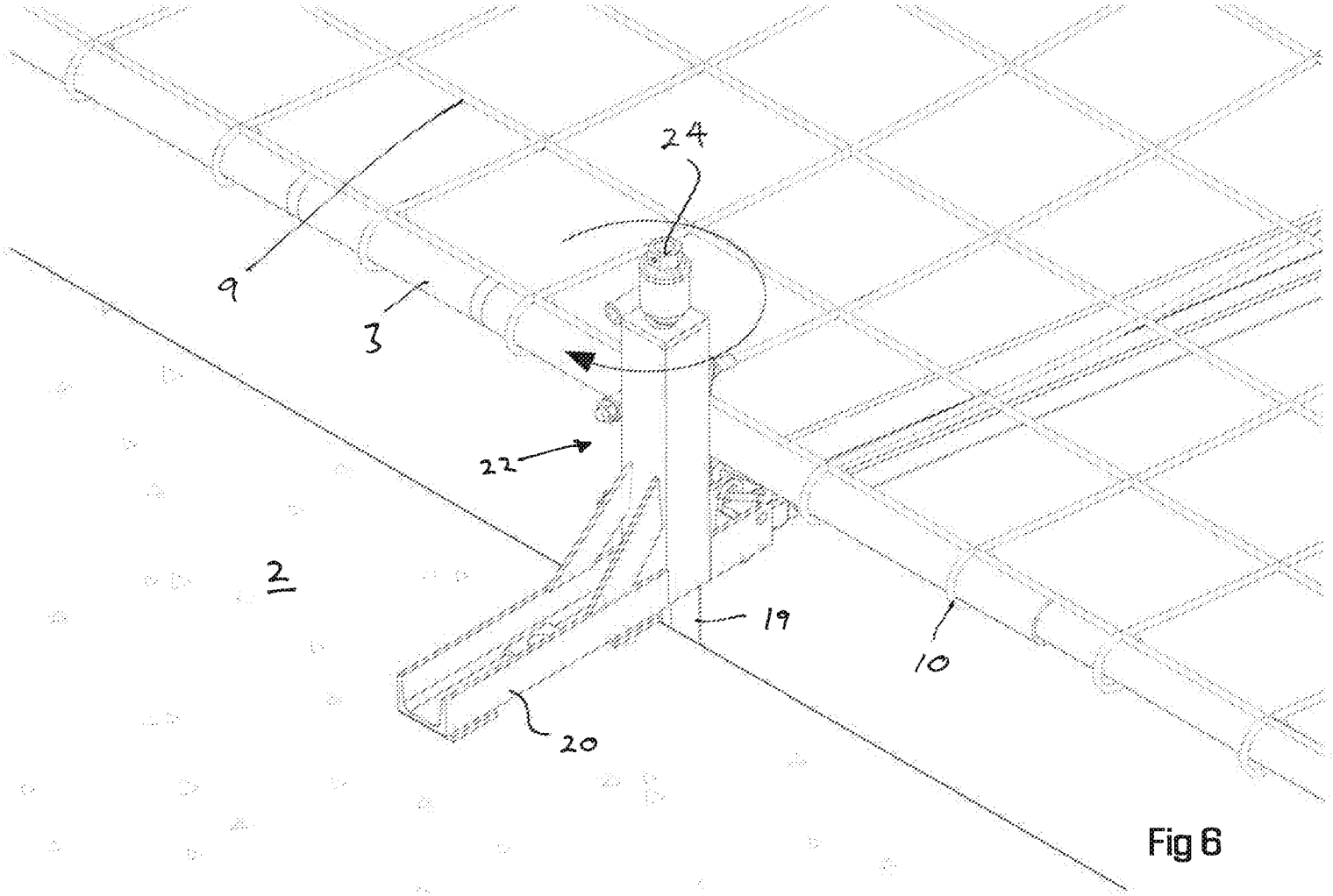
FIG. 6 is an enlarged side detailed view of the floor engaging portion of the safety net of FIG. 4.
Figure 7A:
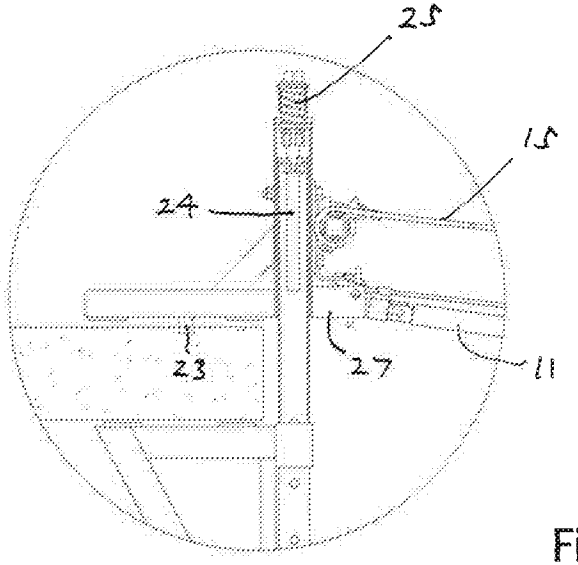
FIG. 7*a* is an enlarged detail view of the floor engaging portion FIG. 7 where the floor engaging portion is in partial section and partially engaged with the floor structure.
Figure 7B:
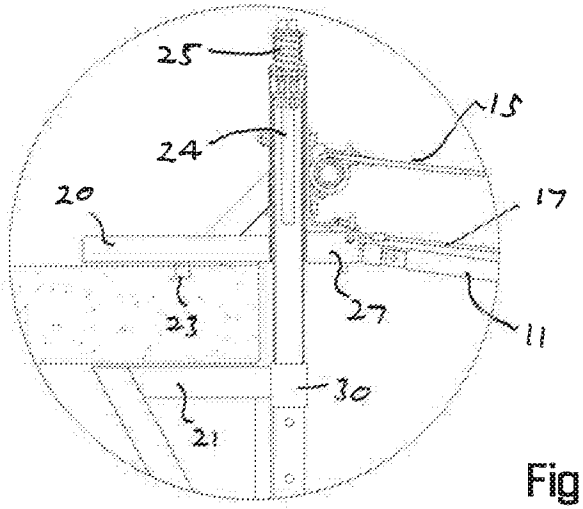
FIG. 7*b* is a view similar to FIG. 7*a*, wherein the floor engaging portion is fully engaged with the floor structure.
Figure 7:
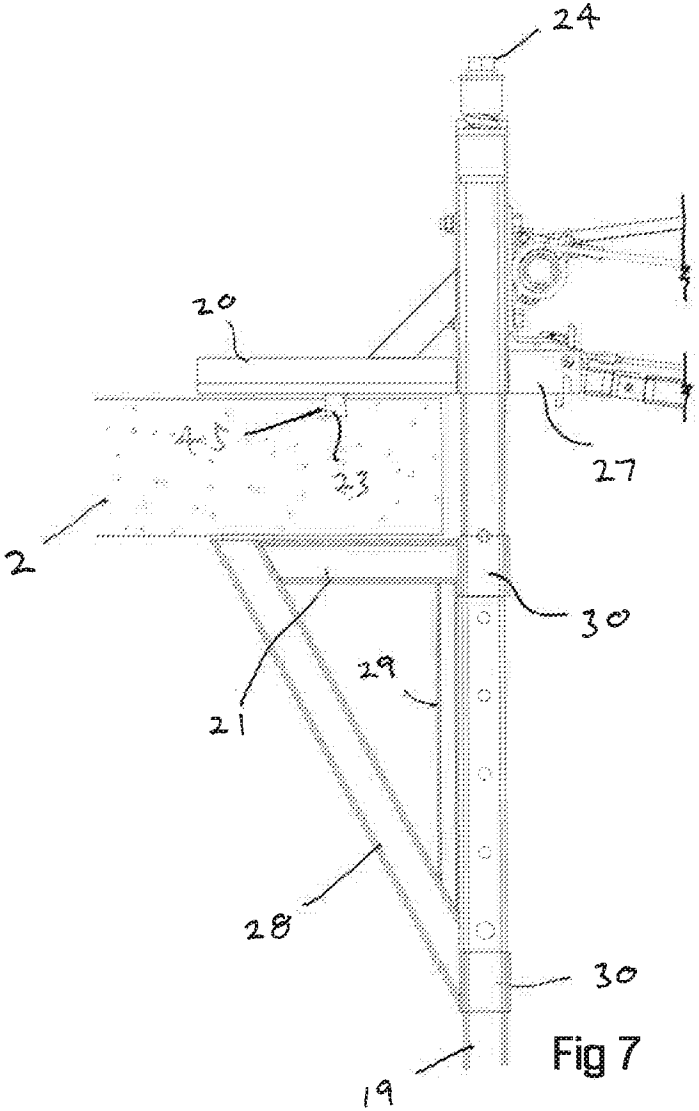
FIG. 7 is a side view of the floor engaging portion of FIG. 6.

A particular embodiment of actuator 22 is shown in FIGS. 5 through 7. In this embodiment actuator 22 includes a threaded bolt 24 received within the upper end of post 19 such that rotating the bolt in a first direction causes upper jaw 20 to be forced downwardly towards lower jaw 21 to thereby engage the respective jaws on opposite sides of floor structure 2. Similarly, rotating threaded bolt 24 in an opposite direction causes upper jaw 20 to slide longitudinally along post 19, away from lower jaw 21, to disengage the jaws from floor structure 2. Bolt 24 may have associated with it a visual indicator to signify when the bolt has been sufficiently torqued to secure upper and lower jaws 20 and 21 about the floor structure.

As shown in FIGS. 7*a* and 7*b*, actuator 22 may also include a compression spring 25 that acts upon threaded bolt 24 in order to help resist unintentional rotation of the bolt and an unintentional disengagement of the jaws from floor structure 2. For example, the floors of a building under construction can at times be subject to vibrational forces. Further, safety net 1 could be exposed to vibration on account of wind loading. In such cases, spring 25 will help to prevent an unintentional loosening of bolt 24 due to vibration. Spring 25 also helps to prevent bolt 24 from being over tightened, which could cause damage to actuator 22 or jaws 20 or 21. It will be appreciated by one of ordinary skill in the art having a complete understanding of the invention that a wide variety of other and alternate structures for actuator 22 could be utilized while remaining within the confines of the invention. It will also be appreciated that actuator 22 may incorporate a visual indicator to demonstrate to an operator when bolt 24 has been sufficiently tightened to securely hold jaws 20 and 21 in place, without over-tightening and causing potential damage to components of safety net 1.

In an embodiment of the invention, floor engaging portion 4 may include a stabilizing arm 28 that extends downwardly at an angle from proximate the interior end of lower jaw 21 to intersect a vertical support 29 that extends vertically upward and generally parallel to post 19 from the lower portion of stabilizing arm 28 to a position proximate the outer end of lower jaw 21. Stabilizing arm 28, vertical support 29 and lower jaw 21 form a triangular structure. The lower portion of stabilizing arm 28 and the outer end of lower jaw 21 and/or the upper end of vertical support 29 may be fitted with sleeves 30 that are slidably received about post 19 to permit lower jaw 21 to be adjusted along the length of post 19 as necessary to accommodate floor structure 2. Bolts or pins can be inserted though sleeves 30 and post 19 to secure the sleeves in place. In an alternate embodiment sleeves 30 can be in the form of a single elongate tube received over post 19. In other embodiments vertical support 29 may be dispensed with.

Figure 11:
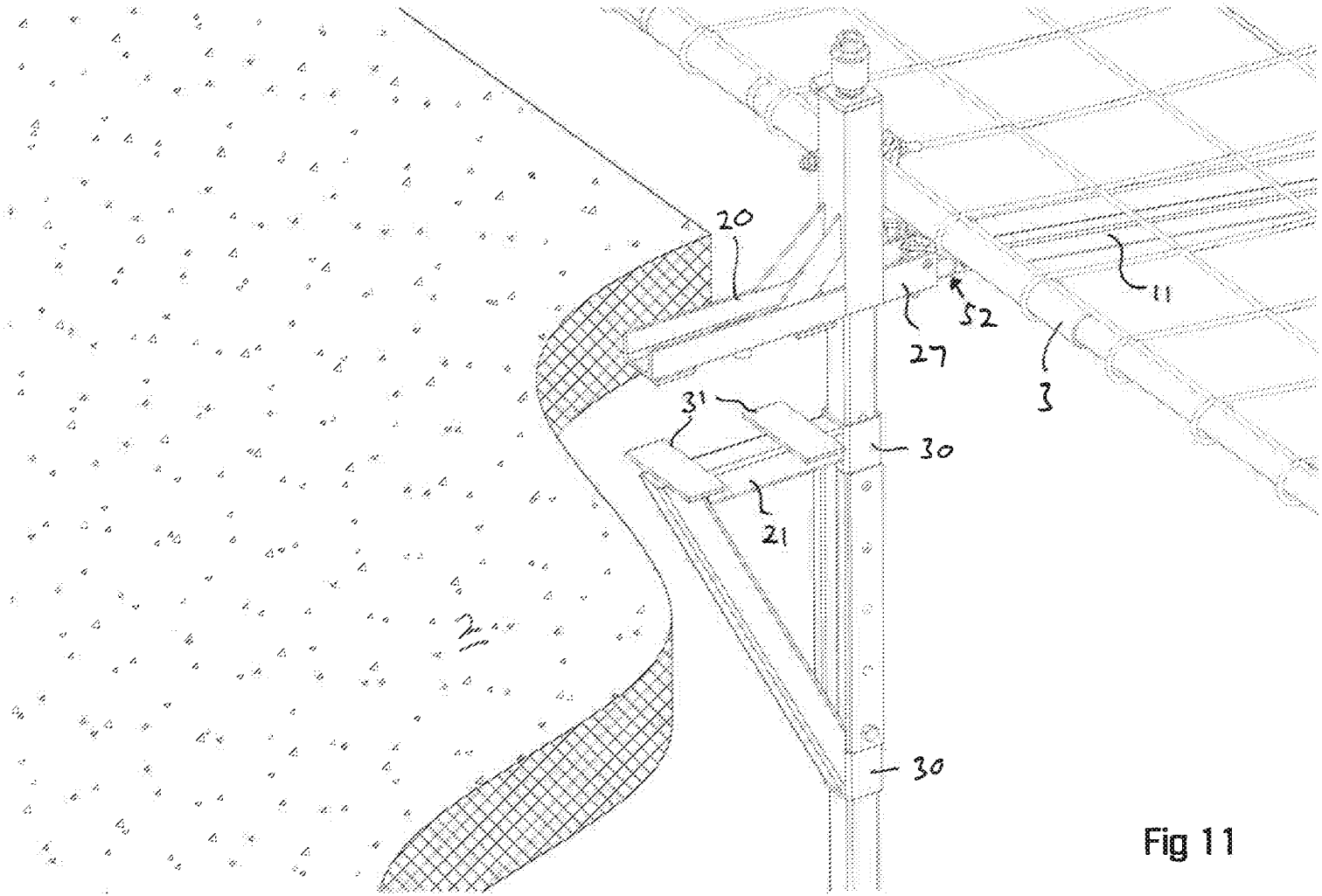
FIG. 11 is an upper side perspective view of the floor engaging portion of the safety net with an adjacent floor structure in partial cut away.

It will be appreciated that the triangular structure of stabilizing arm 28, vertical support 29 and lower jaw 21 will help to prevent lower jaw 21 from tipping or becoming inclined relative to floor 2 during use of safety net 1. Should lower jaw 21 become tipped or inclined there could be the potential for floor engaging pin 23 to become dislodged from recess 45. The triangular structure will also help to maintain post 19 in a generally vertical orientation (particularly when safety net 1 is exposed to horizontal wind loading) and will also generally enhance the stability and structural integrity of floor engaging portion 4. In some instances, to further stabilize floor engaging portions 4 when secured to a floor structure, one or both of upper jaw 20 and lower jaw 21 may include stabilizing flanges 31 (for example, see FIG. 11). The triangular structure presented by stabilizing arm 28, vertical support 29 and lower jaw 21 helps to ensure the integrity of the clamping of the jaw members about a floor structure during operation and under load.

It will thus be understood that the utilization of safety net 1, constructed in accordance with the described invention, presents an ability to mount the safety net to a single floor of a building. This is in contrast to existing safety nets which typically require mounting to multiple floors, between adjacent floors, or that require the use of additional cabling, tie backs, etc. The described structure also presents an ability to easily move the safety net between its deployed and stowed positions and from one location to another.

The utilization of braces 11 significantly increases the structural rigidity of the safety net and enhances the load to which it may be safely exposed. The particular position of the connection of brace 11 to support arm 5, and the general horizontal orientation of brace 11 in use, helps to minimize torque on both support arm 5 and brace 11. The releasable connection of second end 13 of brace 11 to upper jaw 20 reduces torque loading on post 19, while the utilization of shear pin 16 presents additional advantages.

Cable 17 provides an ability to lift brace 11 into a position that permits a worker to easily and quickly re-secure the brace in place when the safety net is being moved from its stowed to its deployed configuration. The operation of upper and lower jaws 20 and 21 and floor engaging pin 23 facilitates the engagement and disengagement of the safety net with floor structure 2.

Safety net 1 can also be used in conjunction with more traditional edge protection, including one or more posts 26 which may be mounted adjacent to floor engaging portions 4 in instances where edge protection fencing, etc. is desired or required by law.

Figure 12:
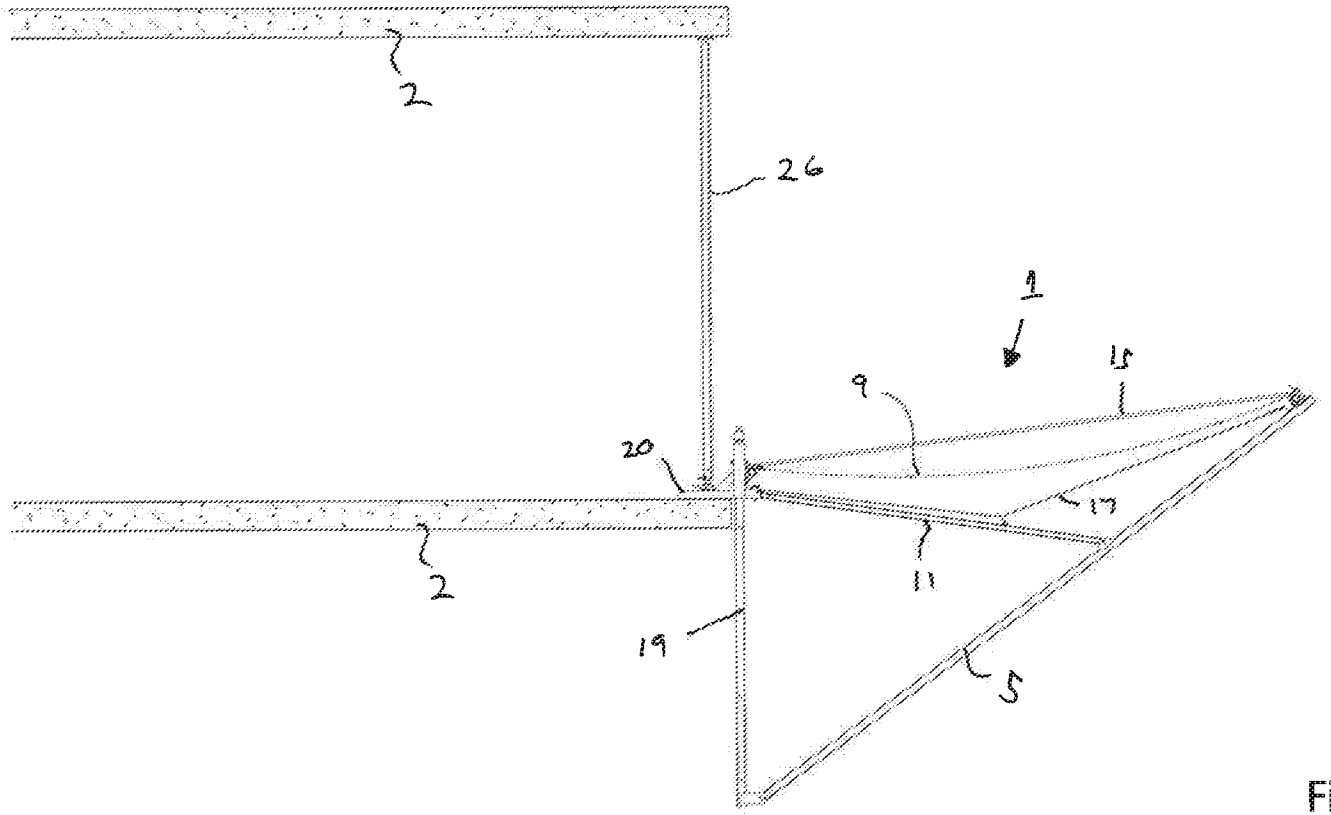
FIG. 12 demonstrates use of a safety net in accordance with an embodiment of the invention in conjunction with a post in an edge protection system.
Figure 13A:
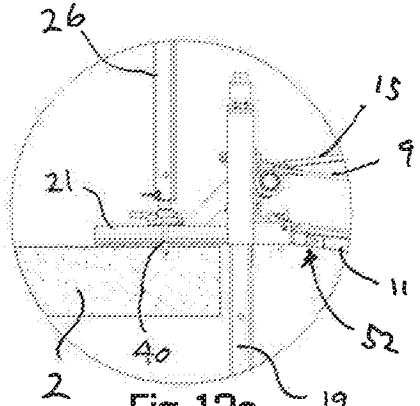
FIG. 13*a* is an enlarged detail view of portion "A" of FIG. 13.
Figure 13:
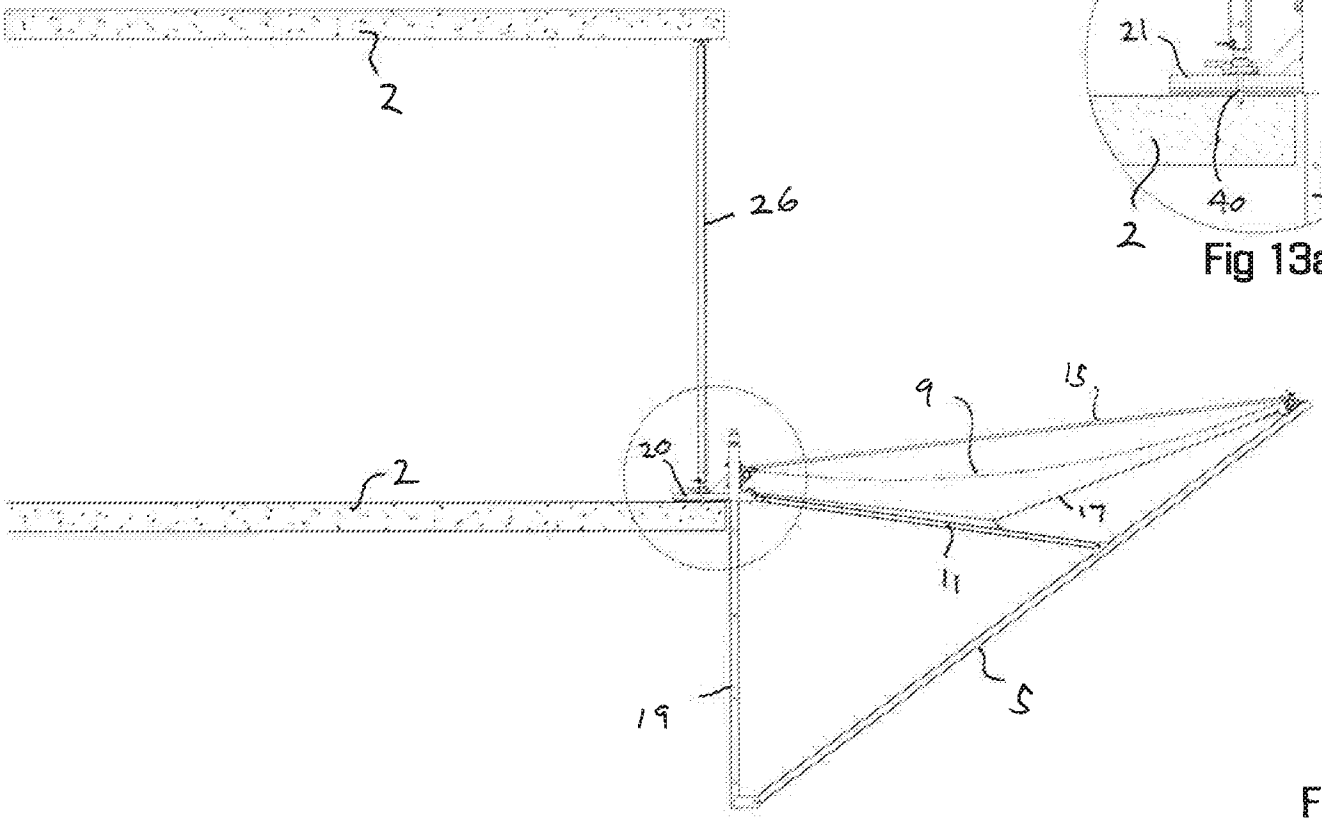
FIG. 13 is a detail view of the embodiment shown in FIG. 12, wherein the upper jaw is in section.

In some cases, lower jaw 21 may be dispensed with, and a post 26, extending between two adjacent floors, may be used to secure or hold upper jaw 20 in place (see FIGS. 12 and 13). In this embodiment, post 26 can be tensioned between two adjacent floor structures so that it bears against upper jaw 20 to hold the upper jaw in place against the floor structure, with or without the aid of the lower jaw. As shown in FIG. 13, in one embodiment post 26 may include a pin 40 on its lower end. Pin 40 can pass through a bore, hole or opening within upper jaw 20 and be received within a recess 45 in floor 2. It will be appreciated that in this embodiment pin 40 will function in a similar fashion as the embodiment where pin 23 is used to help prevent sliding movement of jaw 20 along the floor 2. With pin 40 received through upper jaw 20 and within recess 45, tensioning post 26 between the two adjacent floor structures will secure safety net 1 to floor 2 without necessarily the need for lower jaw 21. Post 26 can also be used to help secure other forms of edge protection, including barrier fencing. In an alternate embodiment, pin 23 may be utilized on the bottom surface of upper jaw 20 and there may not be a in on the lower end of post 26. Here, tensioning post 26 between adjacent floors with its lower end bearing against upper jaw 20 will help to maintain pin 23 within detent 45. In a further embodiment, pin 23 and pin 40 may both be utilized.

It is to be understood that what has been described are the preferred embodiments of the invention. The scope of the claims should not be limited by the preferred embodiments set forth above, but should be given the broadest interpretation consistent with the description as a whole.

I claim:

1. A safety net for multi-storey building construction, the safety net comprising:

a first netting support secured to a plurality of floor engaging portions, each floor engaging portion having a support arm rotatably attached thereto;

a second netting support secured to said support arms; and netting, secured to said first and said second netting supports such that rotation of said support arms causes said netting to move between a deployed and a stowed configuration, each support arm having a rigid brace, wherein when said netting is in said deployed configuration said braces extend between said support arms and their respective floor engaging portions such that a horizontal component of a load applied to said support arms and acting in a direction from the support arms toward the floor engaging portions is at least partially transmitted through said braces directly to said respective floor engaging portions, preventing rotational movement of the support arms and resisting said netting moving to said stowed configuration, wherein each of said braces has a first end rotationally secured to its respective support arm and a second end releasably securable to its respective floor engaging portion, wherein, when said netting is in said stowed configuration, said second ends of said braces are disengaged from their floor engaging portions, wherein, each brace has an associated cable, each of said cables having a first end secured to either said first netting support or said respective floor engaging portion, each of said cables having a second end secured to either said second netting support or an outer end of said respective support arm, each of said cables slidably engaged with its associated brace such that when said safety net is in said stowed configuration with said braces disengaged from said floor engaging portions movement of said netting to said deployed configuration causes a sliding engagement of said braces with their respective cables to move said braces into position for engagement with their respective floor engaging portions, wherein each of said braces includes an eyelet positioned between their first and second ends, the cable associated with an individual brace passing through said eyelet such that the sliding engagement of a cable with its associated brace comprises said cable sliding through the eyelet of said brace.

2. A safety net for multi-storey building construction, the safety net comprising:

a first netting support secured to a plurality of floor engaging portions, each floor engaging portion having a support arm rotatably attached thereto;

a second netting support secured to said support arms; and netting, secured to said first and said second netting supports such that rotation of said support arms causes said netting to move between a deployed and a stowed configuration, each support arm having a rigid brace, wherein when said netting is in said deployed configuration said braces extend between said support arms and their respective floor engaging portions such that a horizontal component of a load applied to said support arms and acting in a direction from the support arms toward the floor engaging portions is at least partially transmitted through said braces directly to said respective floor engaging portions, preventing rotational movement of the support arms and resisting said netting moving to said stowed configuration, wherein each of said braces has a first end rotationally secured to its respective support arm and a second end releasably securable to its respective floor engaging portion, wherein, when said netting is in said stowed configuration, said second ends of said braces are disengaged from their floor engaging portions, wherein, each brace has an associated cable, each of said cables having a first end secured to either said first netting support or said respective floor engaging portion, each of said cables having a second end secured to either said second netting support or an outer end of said respective support arm, each of said cables slidably engaged with its associated brace such that when said safety net is in said stowed configuration with said braces disengaged from said floor engaging portions movement of said netting to said deployed configuration causes a sliding engagement of said braces with their respective cables to move said braces into position for engagement with their respective floor engaging portions, wherein each of said braces includes a shear pin, when said netting in said deployed configuration with said second ends of said braces releasably secured to said floor engaging portions, exposure of said braces to a compressive load exceeding a predetermined value causes said shear pins to shear and permits said safety net to move to or toward said stowed configuration.

3. The safety net as claimed in claim 2 wherein said floor engaging portion comprises a generally vertically oriented post having received thereon an upper and a lower jaw, said upper and lower jaws receivable about upper and lower surfaces of a floor a structure to secure said safety net thereto.

4. The safety net as claimed in claim 3 wherein at least one of said upper and said lower jaws is slidably received about said post, said floor engaging portion including an actuator to slidably move one or both of said upper and lower jaws about said post to bias said jaws against the upper and lower surfaces of the floor structure.

5. A safety net for multi-storey building construction, the safety net comprising:

a first netting support secured to a plurality of floor engaging portions, each floor engaging portion having a support arm rotatably attached thereto;

a second netting support secured to said support arms; and netting, secured to said first and said second netting supports such that rotation of said support arms causes said netting to move between a deployed and a stowed configuration, each support arm having a rigid brace, wherein when said netting is in said deployed configuration said braces extend between said support arms and their respective floor engaging portions such that a horizontal component of a load applied to said support arms and acting in a direction from the support arms toward the floor engaging portions is at least partially transmitted through said braces directly to said respective floor engaging portions, preventing rotational movement of the support arms and resisting said netting moving to said stowed configuration, wherein said floor engaging portion comprises a generally vertically oriented post having received thereon an upper and a lower jaw, said upper and lower jaws receivable about upper and lower surfaces of a floor a structure to secure said safety net thereto, wherein at least one of said upper jaw and said lower jaw includes a floor engaging pin received within a hole or detent in the floor structure when said upper and lower jaws are engaged about the floor structure, said pin resisting sliding movement of said respective jaw relative to the floor structure.

6. The safety net as claimed in claim 5 wherein load transmitted through said brace to its respective floor engaging portion is at least partially transmitted to and borne by said floor engaging pin.

7. The safety net as claimed in claim 4 wherein said actuator includes a bolt threadably received within said floor engaging portion, wherein rotation of said bolt in a first direction compresses said upper and lower jaws against the floor structure and rotation of said bolt in an opposite direction releases said upper and lower jaws from said floor structure, said bolt including a visual indicator to signify when said bolt is sufficiently torqued to hold said jaws about the floor structure.

8. The safety net as claimed in claim 5 wherein said floor engaging portions each include a stabilizing arm, said stabilizing arm assisting in the direction of horizontal loading of said vertically oriented post at least partially to an interior end of said lower jaw to help to maintain said lower jaw and said upper jaw generally parallel to the floor structure.

9. The safety net as claimed in claim 1 wherein said first and said second netting supports are telescopic.

10. A safety net frame for a multi-storey building construction, the safety net frame comprising:

a plurality of floor engaging portions, each floor engaging portion having a support arm with a first end rotatably coupled to said floor engaging portion such that rotation of said support arms relative to said floor engaging portions causes said frame to move between a deployed and a stowed configuration;

a first netting support secured to said floor engaging portions;

a second netting support secured to second opposite ends of said support arms; and a rigid brace associated with each of said support arms, each of said braces having a first end rotatably secured to its respective support arm and having a second end releasably securable to a brace retainer on its respective floor engaging portion, said second ends of said braces disengaged from their respective brace retainers when said frame is in said stowed configuration;

when said frame is in said deployed configuration said braces extending between said respective support arms and their respective floor engaging portions such that a horizontal component of a load applied to said support arms and acting in a direction from the support arms toward the floor engaging portions is at least partially transmitted through said braces directly to said respective floor engaging portions, preventing rotational movement of the support arms and resisting said frame moving to said stowed configuration including a cable associated with each of said braces, each of said cables having a first end secured to said first netting support or to said floor engaging portion, each of said cables having a second end secured to said second netting support or to an outer end of said respective support arm, each of said cables slidably engaged with a cable receiver on an associated brace such that when said frame is in said stowed configuration with said second ends of said braces disengaged from said brace retainers, movement of said frame to said deployed configuration causes the sliding engagement of said cables with said cable receivers such that said braces move to a location with said second ends of said braces adjacent to said brace retainers and in position for re-engagement with said floor engaging portions.

11. A safety net for multi-storey building construction, the safety net comprising:

a first netting support secured to a plurality of floor engaging portions, each floor engaging portion having a support arm rotatably attached thereto, each floor engaging portion including an upper jaw having a floor engaging pin receivable within a hole or detent in an upper surface of a floor structure, said pin, when received within the hole or detent, resisting sliding movement of said upper jaw relative to the floor structure when said safety net is secured thereto;

a second netting support secured to said support arms; and netting, secured to said first and said second netting supports such that rotation of said support arms causes said netting to move between a deployed and a stowed configuration wherein each support arm has a brace, when said netting is in said deployed configuration said brace extending between said support arm and its respective floor engaging portion such that a horizontal component of a load applied to said support arm is at least partially transmitted by said brace from said support arm directly to said respective floor engaging portion, resisting said netting moving to said stowed configuration, wherein each of said braces includes a shear pin, when said frame in said deployed configuration with said second ends of said braces releasably secured to said brace retainers, exposure of said braces to a compressive load exceeding a predetermined value causes said shear pins to shear and permits said safety net to move to or toward said stowed configuration.

12. The safety net frame as claimed in claim 11 including a cable associated with each of said braces, each of said cables having a first end secured to said first netting support or to said floor engaging portion, each of said cables having a second end secured to said second netting support or to an outer end of said respective support arm, each of said cables slidably engaged with a cable receiver on an associated brace such that when said frame is in said stowed configuration with said second ends of said braces disengaged from said brace retainers, movement of said frame to said deployed configuration causes the sliding engagement of said cables with said cable receivers such that said braces move to a location with said second ends of said braces adjacent to said brace retainers and in position for re-engagement with said floor engaging portions.

13. A safety net for multi-storey building construction, the safety net comprising:

a plurality of floor engaging portions, each floor engaging portion having a support arm rotatably attached thereto, each floor engaging portion including an upper jaw engageable with an upper surface of a floor structure; for each floor engaging portion, at least one floor engaging pin receivable within a hole or detent in the upper surface of the floor structure to resist sliding movement of said upper jaws relative to the floor structure when said safety net is secured thereto;

a first netting support secured to a plurality of said floor engaging portions;

a second netting support secured to said support arms;

netting, secured to said first and said second netting supports; and a post for tensioning between the upper surface of the floor structure and a ceiling surface of an immediately adjacent above floor structure, said post engageable with said upper jaw when tensioned in place between said upper surface of the floor structure and the ceiling surface of the immediately adjacent above floor structure to maintain said upper jaw in contact with the upper surface of the floor structure and to maintain said floor engaging pin within the hole or detent, wherein said floor engaging pin is positioned on a bottom surface of said post, said upper jaw having a bore or opening therethrough to permit the receipt of said floor engaging pin and to permit said floor engaging pin to be received within the hole or detent.

14. The safety net as claimed in claim 1, wherein said braces extend beneath the netting when said netting is in said deployed configuration.

* * * * *